US008739767B2

(12) United States Patent
Horiba et al.

(10) Patent No.: US 8,739,767 B2
(45) Date of Patent: Jun. 3, 2014

(54) VAPOR PROCESSING APPARATUS

(75) Inventors: Ayumu Horiba, Wako (JP); Masakazu Kitamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 459 days.

(21) Appl. No.: 13/249,294

(22) Filed: Sep. 30, 2011

(65) Prior Publication Data

US 2012/0097269 A1 Apr. 26, 2012

(30) Foreign Application Priority Data

Oct. 25, 2010 (JP) ..... 2010-238930

(51) Int. Cl.
*F02M 33/02* (2006.01)

(52) U.S. Cl.
USPC ..... 123/520

(58) Field of Classification Search
USPC ..... 123/516, 518, 519, 520
See application file for complete search history.

(56) References Cited

U.S. PATENT DOCUMENTS

| | | | | |
|---|---|---|---|---|
| 6,330,879 | B1 * | 12/2001 | Kitamura et al. | 123/520 |
| 6,470,862 | B2 * | 10/2002 | Isobe et al. | 123/520 |
| 6,736,116 | B2 * | 5/2004 | Kawano | 123/520 |
| 6,796,295 | B2 * | 9/2004 | Kidokoro et al. | 123/520 |
| 7,159,580 | B2 * | 1/2007 | Shikama et al. | 123/520 |

FOREIGN PATENT DOCUMENTS

JP 2001-123891 5/2001

* cited by examiner

*Primary Examiner* — Thomas Moulis
(74) *Attorney, Agent, or Firm* — Ditthavong Mori & Steiner, P.C.

(57) ABSTRACT

A vapor processing apparatus includes a tank-inner-pressure detector, an atmospheric-pressure detector, a canister, a control valve and a controller. The tank-inner-pressure detector is configured to detect tank inner pressure of a fuel tank retaining fuel to be supplied to an engine. The atmospheric-pressure detector is configured to detect atmospheric pressure. The canister is configured to adsorb and collect vapor generated in the fuel tank. The control valve is disposed in a vapor channel connected to the fuel tank. The controller is configured to control opening and closing of the control valve based on a value detected by the tank-inner-pressure detector, a value detected by the atmospheric-pressure detector, and a correction value learned in advance, when in a predetermined state.

8 Claims, 4 Drawing Sheets

VAPOR PROCESSING APPARATUS

CROSS-REFERENCE TO RELATED APPLICATIONS

The present application claims priority under 35 U.S.C. §119 to Japanese Patent Application No. 2010-238930, filed Oct. 25, 2010, entitled "Vapor Processing Apparatus". The contents of this application are incorporated herein by reference in their entirety.

BACKGROUND OF THE INVENTION

1. Field of the Invention

The present invention relates to a vapor processing apparatus.

2. Discussion of the Background

In a fuel tank retaining fuel to be supplied to an engine of a vehicle, part of the fuel evaporates into vapor. To prevent a large quantity of such vapor from being released into the atmosphere, vehicles including engines have vapor processing apparatuses.

For example, if the inner pressure of the fuel tank is high when opening the filler pipe opening, a large amount of vapor will be discharged from the filler pipe opening into the atmosphere, causing air pollution. Therefore, when the filler pipe opening is opened, the vapor generated in the fuel tank is collected by a vapor processing apparatus to prevent the vapor from being discharged into the atmosphere.

The vapor generated in the fuel tank can be supplied to the engine, where it is combusted. However, for a vehicle that uses an engine and a driving motor (i.e., a hybrid vehicle), the engine is driven for a reduced amount of, and thus the vapor may not be fully combusted in the engine. Therefore, for hybrid vehicles in particular, since vapor tends to accumulate in the fuel tank, vapor discharge from the filler pipe opening must be reliably prevented.

For example, Japanese Unexamined Patent Application Publication No. 2001-123891 discloses a vapor-discharge prevention apparatus (vapor processing apparatus) configured to prevent vapor discharge into the atmosphere by maintaining negative pressure in the fuel tank.

With the vapor-discharge prevention apparatus in Japanese Unexamined Patent Application Publication No. 2001-123891, a control valve is controlled in accordance with the pressure inside the fuel tank and the atmospheric pressure to maintain negative pressure in the fuel tank.

The vapor-discharge prevention apparatus that is disclosed in Japanese Unexamined Patent Application Publication No. 2001-123891 detects the absolute pressure of the fuel tank inner pressure with a tank-inner-pressure sensor and detects the absolute pressure of the atmosphere with an atmospheric-pressure sensor. Then, gauge pressure inside the fuel tank, which is based on the atmospheric pressure, is calculated from the atmospheric pressure (absolute pressure) detected by the atmospheric-pressure sensor and the inner pressure (absolute pressure) of the fuel tank detected by the tank-inner-pressure sensor, and a tank-inner-pressure control valve, which controls the inner pressure of the fuel tank, is controlled in accordance with the calculated fuel tank gauge pressure.

SUMMARY OF THE INVENTION

According to one aspect of the present invention, a vapor processing apparatus includes a tank-inner-pressure detector, an atmospheric-pressure detector, a canister, a control valve and a controller. The tank-inner-pressure detector is configured to detect tank inner pressure of a fuel tank retaining fuel to be supplied to an engine. The atmospheric-pressure detector is configured to detect atmospheric pressure. The canister is configured to adsorb and collect vapor generated in the fuel tank. The control valve is disposed in a vapor channel connected to the fuel tank. The controller is configured to control opening and closing of the control valve based on a value detected by the tank-inner-pressure detector, a value detected by the atmospheric-pressure detector, and a correction value learned in advance, when in a predetermined state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
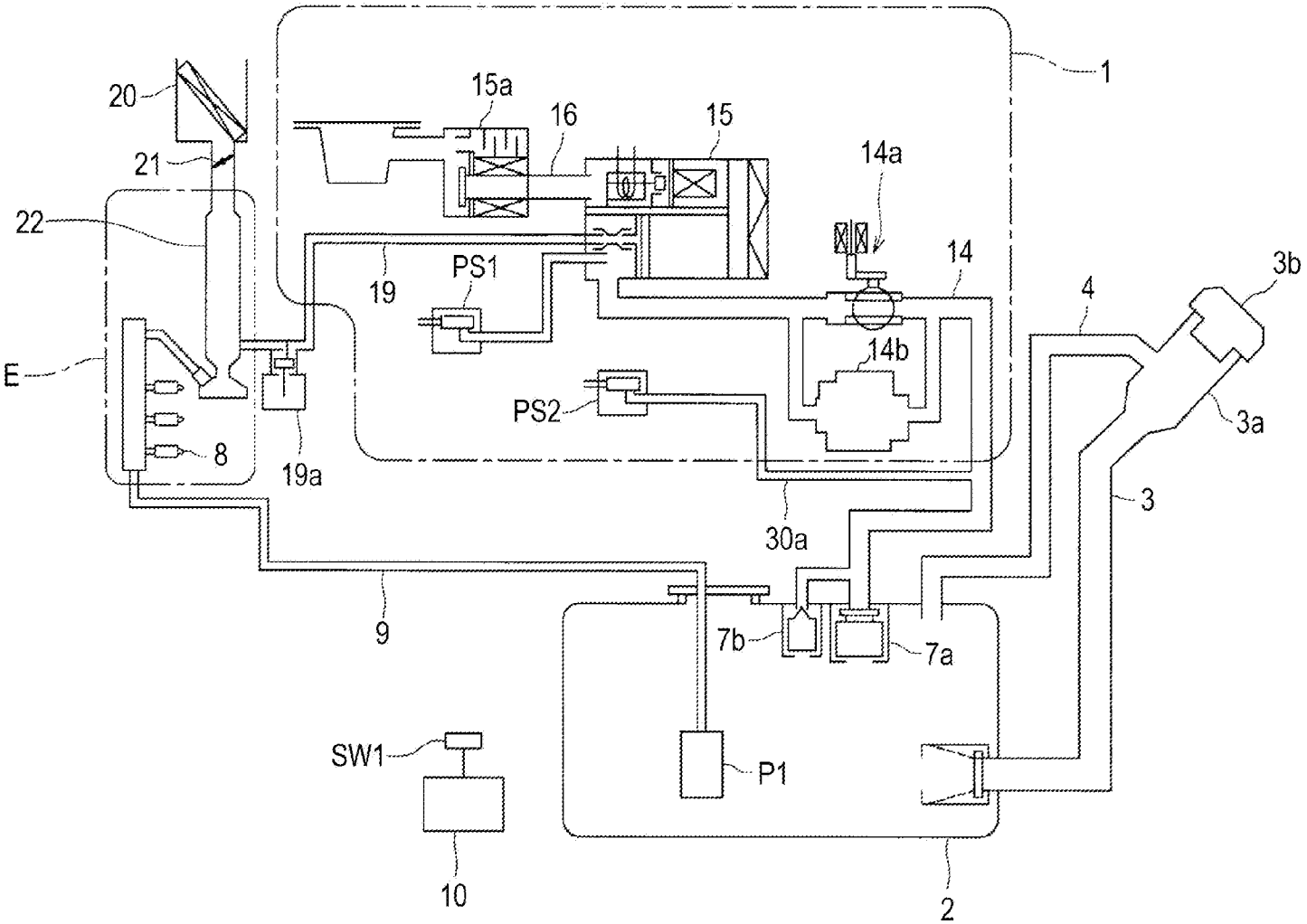
FIG. 1 illustrates a fuel supply system including a vapor processing apparatus according to a first embodiment.

An embodiment of the present invention provides a vapor processing apparatus including a tank-inner-pressure detector configured to detect tank inner pressure of a fuel tank retaining fuel to be supplied to an engine; an atmospheric-pressure detector configured to detect atmospheric pressure; a canister configured to adsorb and collect vapor generated in the fuel tank; a control valve disposed in a vapor channel connected to the fuel tank; and a controller configured to control the opening and closing of the control valve on the basis of a value detected by the tank-inner-pressure detector, a value detected by the atmospheric-pressure detector, and a correction value learned in advance, when in a predetermined state.

With the embodiment of the present invention, the opening and closing of the control valve disposed in the vapor channel through which air containing vapor generated in the fuel tank flows to the canister can be controlled on the basis of the value detected by the tank-inner-pressure detector, the value detected by the atmospheric-pressure detector, and the correction value learned in advance.

Thus, the opening and closing of the control valve can be controlled on the basis of a pressure value, which absorbs an error that occurs in at least one of the tank-inner-pressure detector and the atmospheric-pressure detector with the correction value. Accordingly, even when an error occurs in at least one of the tank-inner-pressure detector and the atmospheric-pressure detector, the opening and closing of the control valve disposed in the vapor channel can be controlled by absorbing the error, and the vapor generated in the fuel tank can be reliably adsorbed at the canister by setting a desirable flow rate of the air containing the vapor flowing through the vapor channel. In this way, vapor discharge can be reliably prevented.

In the vapor processing apparatus, the controller may calculate gauge pressure of the tank inner pressure based on the atmospheric pressure on the basis of the value detected by the tank-inner-pressure detector and the value detected by the atmospheric-pressure detector and may control the opening and closing of the control valve on the basis of corrected gauge pressure obtained by correcting the calculated gauge pressure of the tank inner pressure with the correction value.

With the embodiment, the controller absorbs the error that occurs in the tank-inner-pressure detector and/or the atmospheric-pressure detector by correcting the error with the correction value learned in advance and calculates the gauge pressure of the tank inner pressure, which is based on the atmospheric pressure. The controller can control the opening and closing of the control valve on the basis of the calculated gauge pressure of the tank inner pressure.

Thus, the controller controls the opening and closing of the control valve on the basis of the gauge pressure, which is acquired by absorbing the error that occurs in the tank-inner-pressure detector and/or the atmospheric-pressure detector, with the correction value.

In the embodiment, the controller may learn the correction value on the basis of the difference between the value detected by the tank-inner-pressure detector when the tank inner pressure is equal to the atmospheric pressure and the value detected by the atmospheric-pressure detector.

With the embodiment, the controller learns the difference between the value detected by the tank-inner-pressure detector and the atmospheric-pressure detector, when the tank inner pressure of the fuel tank equals the atmospheric pressure, as the correction value.

In the embodiment, the tank inner pressure may equal the atmospheric pressure when the locked state of a fuel lid is released. The fuel lid opens and closes a filler pipe opening of the fuel tank.

With the embodiment, the controller determines that the tank inner pressure equals the atmospheric pressure when the locked state of the fuel lid, which opens and closes the filler pipe opening of the fuel tank, is released. Then, the controller learns the correction value.

In the embodiment, the tank inner pressure may equal the atmospheric pressure when, after the control valve is open, a variation of the value detected by the tank-inner-pressure detector is smaller than a threshold set in advance.

With the embodiment, the controller determines that the tank inner pressure equals the atmospheric pressure when, after the control valve is open, a variation of the value detected by the tank-inner-pressure detector is smaller than a threshold set in advance. Then, the controller learns the correction value.

In the embodiment, the vapor processing apparatus may further include a switching section configured to switch between a first state of the tank-inner-pressure detector detecting the tank inner pressure and a second state of the tank-inner-pressure detector detecting the atmospheric pressure, wherein the controller switches the switching section to the first state when in the predetermined state and controls the opening and closing of the control valve on the basis of the value detected by the tank-inner-pressure detector, the value detected by the atmospheric-pressure detector, and the correction value and switches the switching section to the second state when in a state other than the predetermined state and learns the correction value.

With the embodiment, the tank-inner-pressure detector detects the tank inner pressure and the atmospheric pressure in accordance with the switching by the switching section. Then, the controller learns the difference between the value detected when the tank-inner-pressure detector detects the atmospheric pressure and the value detected by the atmospheric-pressure detector as the correction value.

Furthermore, the controller controls the opening and closing of the control valve disposed in the vapor channel on the basis of the value detected when the tank-inner-pressure detector detects the atmospheric pressure, the value detected by the atmospheric-pressure detector, and the learned correction value.

In the embodiment, the controller may learn the correction value on the basis of the difference between the value detected by the tank-inner-pressure detector and the value detected by the atmospheric-pressure detector when the switching section is switched to the second state.

With the embodiment, the controller learns the difference between the value detected by the tank-inner-pressure detector and the value detected by the atmospheric-pressure detector when the switching section is switched to the second state as the correction value.

The embodiment of the present invention provides a vapor processing apparatus capable of accurately calculating fuel tank gauge pressure, regardless of an error in a pressure sensor detecting atmospheric pressure and/or a pressure sensor detecting pressure in the fuel tank and reliably adsorbing vapor by letting the vapor flow into a canister at a flow rate corresponding to the calculated fuel tank gauge pressure.

The embodiments will now be described with reference to the accompanying drawings, wherein like reference numerals designate corresponding or identical elements throughout the various drawings.

First Embodiment

A first embodiment of the present invention will be described in detail below with reference to the drawings.

A vapor processing apparatus according to the first embodiment is included in a fuel supply system that supplies fuel to an engine of, for example, a hybrid vehicle, having an engine and a driving motor.

As illustrated in FIG. 1, a fuel supply system of a hybrid vehicle (not shown) pumps up fuel that is retained in a fuel tank 2 with a fuel pump P1, lets the fuel flow through a fuel supply pipe 9, and supplies the fuel to an engine E.

The engine E is, for example, a gasoline engine including a plurality of injectors 8, which mix air that is taken in by an intake manifold 22 through an air cleaner 20 and a throttle valve 21 with vaporized fuel that is supplied from the fuel tank 2 and injects the air/fuel mixture into cylinders (not shown).

The fuel tank 2 is connected to a filler pipe 3 having a filler pipe opening 3*a* used for fueling.

The filler pipe opening 3*a* has a fuel cap (not shown); the fuel cap can be attached and detached when a fuel lid 3*b*, which opens and closes the filler pipe opening 3*a*, is opened. The fuel lid 3*b* can be locked such that it does not open in a normal state (i.e., can assume a locked state). For example, a control signal (for example, electrical signal) from a controller 10 when an open command from a lid switch SW1, which is operated by a driver, is detected releases the lock, allowing the driver to open the fuel lid 3*b* and remove the fuel cap. Instead, the fuel lid 3*b* may be automatically and electrically opened by an actuator, such as a motor (not shown), driven by a control signal output when the controller 10 detects an open command.

The fuel lid 3*b* remains open while an open command is being output from the lid switch SW1. The fuel lid 3*b* is locked by a control signal output when the controller 10 detects a close command from a lid monitor (not shown), which detects the fuel lid 3*b* being closed by the driver. The lid switch SW1 is a command outputting unit configured to output an open command to the fuel lid 3*b*.

The fuel cap (not shown) may include a lock mechanism that is opened by a control signal output from the controller 10 on the basis of an open command from the lid switch SW1. In such a case, it is desirable that the lock mechanism be controlled such that the controller 10 locks the fuel cap upon receiving a close command from the cap monitor, which detects the fuel cap being attached to the filler pipe opening 3*a*.

The fuel tank 2 and the filler pipe opening 3*a* are connected with a vapor return tube 4 so that fuel vaporized during fueling flows back to the filler pipe opening 3*a*.

In a hybrid vehicle including the above-described fuel supply system, part of the fuel retained in the fuel tank 2 vaporizes inside the fuel tank 2.

Therefore, such a hybrid vehicle includes a vapor processing apparatus 1, which discharges vapor generated in the fuel tank 2 to the outside and prevents the vapor discharged from the fuel tank 2 from being discharged to the outside (i.e., into the atmosphere).

The vapor processing apparatus 1 discharges the vapor generated from the fuel tank 2 and collects the vapor mainly during fueling. The vapor processing apparatus 1 includes a canister 15, which is connected to the fuel tank 2 via a relatively thick vapor channel 14.

The canister 15 includes, for example, an adsorbent that adsorbs and collects vapor contained in the air pushed out from the fuel tank 2 due to the fuel injected into the fuel tank 2 during fueling. The canister 15 prevents the vapor from being discharged into the atmosphere.

The canister 15 is connected to a canister filter 15*a* via a drain pipe 16. The clean air remaining after the vapor is adsorbed passes through the canister filter 15*a* and is discharged into the atmosphere.

The canister filter 15*a* removes dust etc. contained in the air remaining after the vapor is adsorbed.

The vapor channel 14 connecting the canister 15 and the fuel tank 2 branches into two parts at the connecting part of the fuel tank 2. One of the branching parts has a fueling float 7*a*, and the other branching part has a cut valve 7*b*. The fueling float 7*a* detects when the fuel tank 2 is filled with fuel (i.e., full tank) during fueling. The cut valve 7*b* is closed to prevent fuel from leaking out from the fuel tank 2 when the fuel tank 2 largely tilts greatly.

The vapor channel 14 includes a vapor control valve 14*a*. The vapor control valve 14*a* is, for example, an electromagnetic valve, such as a solenoid valve or an on-off valve; the solenoid valve can be opened and closed in synchronization with an open command for the fuel lid 3*b* output from the lid switch SW1, and the on-off valve is capable of controlling the duty ratio.

Specifically, upon detecting an open command for the fuel lid 3*b* output from the lid switch SW1, the controller 10 outputs a control signal to open the vapor control valve 14*a*. Upon detecting a close command output from the lid monitor (not shown), the controller 10 outputs a control signal to close the vapor control valve 14*a*.

Instead, the vapor control valve 14*a* may open and close in synchronization with the opening and closing of the fuel lid 3*b*.

The vapor control valve 14*a* may be an opening control valve, whose degree of opening is controllable; the vapor control valve 14*a* may be opened and closed by the controller 10 such that the open/close state and the degree of opening is adjusted.

The canister 15 is connected to the intake manifold 22 via a purge pipe 19, which includes a purge control valve 19*a*. When the purge control valve 19*a* and the vapor control valve 14*a* are opened while the engine E is driven, the vapor generated inside the fuel tank 2 is sucked in by the negative pressure of the intake manifold 22 and is discharged from the injectors 8 to the cylinders (not shown).

Such a configuration enables the vapor generated inside the fuel tank 2 to be discharged from the fuel tank 2 and supplied (purged) to the engine E, where it is combusted, while the engine E is being driven.

The controller 10 opens the vapor control valve 14*a* to discharge the vapor in the fuel tank 2 while the engine E is being driven and allows the vapor from the fuel tank 2 to be combusted at the engine E.

For example, the controller 10 opens the vapor control valve 14*a* when the purge rate of the vapor, which is sent from the canister 15 to the intake manifold 22, from the fuel tank 2 exceeds a predetermined rate.

The purge rate in this case can be determined, for example, from the negative pressure of the intake manifold 22. When the negative pressure of the intake manifold 22 is great, the amount of air taken in from the fuel tank 2 to the intake manifold 22 via the canister 15 increases, and as a result, the amount of vapor sent from the canister 15 to the intake manifold 22 also increases. Thus, the purge rate of vapor from the fuel tank 2 increases.

By preparing a map illustrating the relationship between the negative pressure of the intake manifold 22 and the purge rate of vapor from the fuel tank 2, the controller 10 can refer to this map to obtain the purge rate of vapor sent from the fuel tank 2 to the intake manifold 22 in the engine E via the canister 15, corresponding to the negative pressure of the intake manifold 22.

The controller 10 opens the vapor control valve 14*a* in response to a predetermined state in which the vapor purge rate obtained in this way exceeds a predetermined rate. At this time, the controller 10 fully opens the vapor control valve 14*a* to increase the air flow rate of air in the vapor channel 14. In this way, the vapor contained in the air flowing through the vapor channel 14 is supplied to the intake manifold 22 without being adsorbed by the adsorbent of the canister 15.

The predetermined purge rate of which the controller 10 determines as being in the predetermined state can be set to, for example, the purge rate obtained when the engine E is driven to run the hybrid vehicle and can be determined by a characteristic value, which is obtained through experimental measurement, etc. and determined by the configuration of the hybrid vehicle, the engine E, etc.

However, with a hybrid vehicle, since the filler pipe 3 is not driven for a large amount of time, and vapor in the fuel tank 2 cannot be sufficiently purged while driving the engine E. Therefore, the controller 10 adsorbs the vapor in the fuel tank 2 with the canister 15 by opening the vapor control valve 14*a* during fueling.

As described above, during fueling, vapor is contained in the air pushed out from the fuel tank 2 by fuel injected into the fuel tank 2 during fueling. The vapor can be adsorbed by an adsorbent in the canister 15 by injecting the air into the canister 15.

The controller 10 opens the vapor control valve 14*a* during fueling and allows the vapor generated in the fuel tank 2 to be adsorbed at the canister 15.

However, if the pressure inside the fuel tank 2 (hereinafter, referred to as tank inner pressure) is high when the filler pipe opening 3*a* is opened by removing the fuel cap (not shown), the vapor retained in the fuel tank 2 is discharged from the filler pipe opening 3*a* into the atmosphere, causing air pollution. Thus, before the controller 10 opens the fuel lid 3*b* for fueling, the vapor in the fuel tank 2 is adsorbed at the canister 15.

For example, when the lid switch SW1 is operated by the driver to open the fuel lid 3*b* and outputs an open command for the fuel lid 3*b*, the controller having the above-described configuration opens the vapor control valve 14*a* to reduce the tank inner pressure, as required when the tank inner pressure does not equal atmospheric pressure.

The driver removing the fuel cap (not shown) when the tank inner pressure is higher than the atmospheric pressure may cause the vapor generated inside the fuel tank 2 to be discharged into the atmosphere and/or fuel leakage through the filler pipe 3. Therefore, even when the controller 10 receives an open command for the fuel lid 3*b*, the fuel lid 3*b* is not opened until the tank inner pressure equals the atmospheric pressure.

Accordingly, it is desirable that the controller 10 receives an operation signal (for example, an electric signal) that is output when the lid switch SW1 is operated.

For example, high and low voltages are output from the lid switch SW1, which is operated by a toggle, as operation signals; the controller 10 recognizes one of the voltage values (for example, the low voltage) as an open command and recognizes the other voltage value (for example, the high voltage) as a close command.

Upon receiving an open command from the lid switch SW1, the controller 10 sends a control signal to (the driving unit of) the fuel lid 3*b*, as required, to release the locked state of the fuel lid 3*b*.

When controlling the opening and closing of the vapor control valve 14*a*, the controller 10 may set the open/close timing and the degree of opening of the vapor control valve 14*a* in accordance with the tank inner pressure.

When the vapor control valve 14*a* is an opening control valve, the controller 10 sets the vapor control valve 14*a* with a small degree of opening when the tank inner pressure is high and with a large degree of opening when the tank inner pressure is low.

When the tank inner pressure is high, the flow rate of the air discharged from the fuel tank 2 and flowing through the vapor channel 14 is high. If the air flows into the canister 15 at this high flow rate, the vapor cannot be efficiently adsorbed. Thus, when the tank inner pressure is high, the controller 10 decreases the degree of opening of the vapor control valve 14*a* to lower the flow rate in the vapor channel 14 so that the vapor can be efficiently adsorbed When the tank inner pressure is low, the flow rate of air discharged from the fuel tank 2 and flowing through the vapor channel 14 is low. Hence, the vapor contained in the air, which is flowing into the canister 15 at a low flow rate, can be efficiently adsorbed. Accordingly, when the tank inner pressure is low, the controller 10 increases the degree of opening of the vapor control valve 14*a* to maintain the flow rate of air in the vapor channel 14 and quickly reduces the tank inner pressure.

The degree of opening of the vapor control valve 14*a* corresponding to the tank inner pressure can be set by the controller 10 referring to, for example, a map representing the relationship between the tank inner pressure and the degree of opening of the vapor control valve 14*a*. Such a map can be obtained through experimental measurement, etc. of characteristic values of the vapor processing apparatus 1.

As described above, when the vapor control valve 14*a* is an opening control valve, the controller 10 can set the degree of opening of the vapor control valve 14*a*.

The vapor channel 14 includes a negative-pressure cutting valve 14*b*, which is in parallel with the vapor control valve 14*a*. The negative-pressure cutting valve 14*b* lets air flow from the fuel tank 2 to the canister 15 when the tank inner pressure of the fuel tank 2 is positive pressure and lets air flow from the canister 15 to the fuel tank 2 when the tank inner pressure of the fuel tank 2 is negative pressure. The negative-pressure cutting valve 14*b* mainly protects the fuel tank 2 by preventing the inner pressure of the fuel tank 2 from becoming negative. Here, positive pressure is pressure higher than the atmospheric pressure, and negative pressure is pressure lower than the atmospheric pressure.

As described above, since the controller 10 controls the opening and closing of the vapor control valve 14*a* in accordance with the tank inner pressure during fueling, the controller 10 constantly monitors the tank inner pressure. Therefore, the vapor processing apparatus 1 includes a tank-inner-pressure sensor PS2, which is tank-inner-pressure detector, configured to detect the tank inner pressure.

The tank-inner-pressure sensor PS2 is disposed in, for example, the vapor channel 14, which is constantly communicating with the fuel tank 2, and detects the absolute pressure inside the fuel tank 2. The tank-inner-pressure sensor PS2 allows the controller 10 to detect the tank inner pressure as an absolute pressure.

The part in which the tank-inner-pressure sensor PS2 is disposed is not limited. FIG. 1 illustrates an example configuration in which the tank-inner-pressure sensor PS2 is disposed in a tank-side pressure pipe 30*a* extending from a section between the fuel tank 2 and the vapor control valve 14*a*.

The tank-inner-pressure sensor PS2 detects the absolute value of the tank inner pressure and allows the controller 10 to detect the tank inner pressure as an absolute pressure.

Since the flow rate of the air flowing through the vapor channel 14 varies depending on the difference between the atmospheric pressure of the environment in which the hybrid vehicle runs and the absolute value of the tank inner pressure, it is desirable that the controller 10 control the opening and closing of the vapor control valve 14*a* in accordance with, for example, the difference between the atmospheric pressure and the absolute pressure of the tank inner pressure during fueling. Therefore, it is desirable that the controller 10 be able to calculate the difference (gauge pressure) between the atmospheric pressure and the tank inner pressure, which is absolute pressure. Hereinafter, the gauge pressure of the tank inner pressure will be referred to as tank inner gauge pressure. The tank inner gauge pressure is gauge pressure based on the atmospheric pressure.

In addition to the tank inner pressure (absolute pressure), atmospheric pressure (absolute pressure) should be detected for the controller 10 to calculate the tank inner gauge pressure; therefore, the vapor processing apparatus 1 includes an atmospheric-pressure sensor PS1, which is an atmospheric-pressure detector, configured to detect the absolute pressure of the atmospheric pressure. The controller 10 calculates the difference ((tank inner pressure)−(atmospheric pressure)) between the atmospheric pressure (absolute pressure) detected by the atmospheric-pressure sensor PS1 and the tank inner pressure detected by the tank-inner-pressure sensor PS2 as tank inner gauge pressure and controls the opening and closing of the vapor control valve 14*a* on the basis of the calculated tank inner gauge pressure.

The position of the atmospheric-pressure sensor PS1 is not limited so long as atmospheric pressure (absolute pressure) can be detected. For example, FIG. 1 illustrates an example configuration in which the atmospheric-pressure sensor PS1 is disposed at a part exposed to atmospheric pressure.

Instead of providing the atmospheric-pressure sensor PS1 in the canister 15, a purge-flow-rate sensor (PA sensor) (not shown) or a manifold pressure sensor (MAP sensor) may be provided.

However, as described above, when error occurs in the atmospheric-pressure sensor PS1 and the tank-inner-pressure sensor PS2, the tank inner gauge pressure calculated by the controller 10 will include doubled errors, and, thus, the controller 10 cannot calculate accurate tank inner gauge pressure.

For example, as described above, when the driver operates the lid switch SW1, the locked state of the fuel lid 3*b* is released when the inner pressure of the fuel tank 2 equals the atmospheric pressure. In this embodiment, the controller 10 determines whether the inner pressure of the fuel tank 2 equals the atmospheric pressure on the basis of the calculated tank inner gauge pressure. Therefore, if accurate tank inner gauge pressure cannot be calculated, the controller 10 may determine that the inner pressure of the fuel tank 2 equals the atmospheric pressure, when the inner pressure of the fuel tank 2 is actually higher than the atmospheric pressure. In such a case, the locked state of the fuel lid 3*b* will be released when the inner pressure of the fuel tank 2 is higher than the atmospheric pressure. At this time, if the fuel lid 3*b* is opened and the fuel cap (not shown) is removed, a large amount of vapor may be discharged from the fuel tank 2 to the atmosphere.

Accordingly, the controller 10 of this embodiment has an ability of learning, in advance, correction values that absorb the errors of the atmospheric-pressure sensor PS1 and the tank-inner-pressure sensor PS2. The errors of the atmospheric-pressure sensor PS1 and the tank-inner-pressure sensor PS2 are, for example, errors due to the usage environment, such as temperature, and/or intrinsic errors unique to the atmospheric-pressure sensor PS1 and the tank-inner-pressure sensor PS2.

For example, when the fuel cap (not shown) is removed and the filler pipe opening 3*a* is opened for fueling, the fuel tank 2 is exposed to the atmosphere, causing the atmospheric pressure (absolute pressure) and the tank inner pressure (absolute pressure) to become equal. Thus, if errors do not occur in the atmospheric-pressure sensor PS1 and the tank-inner-pressure sensor PS2, the value PA detected by the atmospheric-pressure sensor PS1 and the value PTANK detected by the tank-inner-pressure sensor PS2 are equal. In other words, when the filler pipe opening 3*a* is opened, PA=PTANK.

If an error occurs in at least one of the atmospheric-pressure sensor PS1 and the tank-inner-pressure sensor PS2, the value PA detected by the atmospheric-pressure sensor PS1 and the value PTANK detected by the tank-inner-pressure sensor PS2 do not become equal.

The controller 10 learns the difference between the value PA detected by the atmospheric-pressure sensor PS1 and the value PTANK detected by the tank-inner-pressure sensor PS2 when the filler pipe opening 3*a* is open as a correction value Prev.

For example, when the filler pipe opening 3*a* is open, if the value PA detected by the atmospheric-pressure sensor PS1 is 760 mmHg (1013.2 hPa) and the value PTANK detected by the tank-inner-pressure sensor PS2 is 762 mmHg (1015.9 hPa), the correction value Prev is −2 mmHg (−2.7 hPa). That is, the difference PA−PTANK of the value PA detected by the atmospheric-pressure sensor PS1 and the value PTANK detected by the tank-inner-pressure sensor PS2 is set as the correction value Prev.

The controller 10 stores the correction value Prev calculated in this way in a storage unit (not shown), such as a non-volatile memory. This process of calculating the correction value Prev and storing the calculated correction value Prev is referred to as "correction value learning" performed by the controller 10.

When the vapor control valve 14*a* is opened after learning the correction value Prev, the controller 10 corrects the tank inner gauge pressure, which is calculated from the difference between the value PA detected by the atmospheric-pressure sensor PS1 and the value PTANK detected by the tank-inner-pressure sensor PS2, with the learned correction value Prev. The tank inner gauge pressure corrected with the correction value Prev in this way is, in particular, referred to as "corrected gauge pressure".

Specifically, the controller 10 sets the pressure value calculated using the following Expression 1 as the corrected gauge pressure.

$$\text{Corrected gauge pressure}=(\text{PTANK}-\text{PA})+\text{Prev} \quad (1)$$

The corrected gauge pressure is a pressure value obtained by correcting the tank inner gauge pressure, which is based on atmospheric pressure and calculated on the basis of the value PA detected atmospheric-pressure sensor PS1 and the value PTANK detected by the tank-inner-pressure sensor PS2, with the correction value Prev.

For example, when the lid switch SW1 is operated to output an open command for the fuel lid 3*b* and the value PA detected by the atmospheric-pressure sensor PS1 is 740 mmHg (986.6 hPa), the value PTANK detected by the tank-inner-pressure sensor PS2 is 806 mmHg (1074.6 hPa), and the correction value Prev is −2 mmHg (−2.7 hPa), the controller 10 sets the corrected gauge pressure to 64 mmHg (85.3 hPa), which is result of the calculation using Expression 1 (PTANK−PA)+Prev. As a result, the error 2 mmHg (2.7 hPa) of the tank inner gauge pressure before correction (66 mmHg (88.0 hPa), which is calculated using PTANK−PA, can be absorbed.

The controller 10 controls the opening and closing of the vapor control valve 14*a* on the basis of the corrected gauge pressure corrected using the correction value Prev.

When the vapor control valve 14*a* is an opening control valve, the controller 10 sets the degree of opening of the vapor control valve 14*a* on the basis of the corrected gauge pressure corrected using the correction value Prev.

That is, since the tank inner pressure may be high when the corrected gauge pressure is positive, the degree of opening and the opening speed of the vapor control valve 14*a* is set great when the corrected gauge pressure is positive to quickly adsorb the vapor inside the fuel tank 2 at the canister 15.

With this configuration, even if an error occurs in at least one of the atmospheric-pressure sensor PS1 and the tank-inner-pressure sensor PS2, the controller 10 can accurately calculate the corrected gauge pressure by absorbing the error and can precisely control the opening and closing of the vapor control valve 14*a* on the basis of the accurate corrected gauge pressure. Therefore, the flow rate of the air discharged from the fuel tank 2 and flowing through the vapor channel 14 can be set to a desirable rate corresponding to the tank inner gauge pressure, and the vapor contained in the air flowing through the vapor channel 14 can be satisfactorily adsorbed (collected) at the canister 15.

A desirable flow rate is the flow rate of the air containing vapor that flows through the vapor channel 14 to the canister 15 and is a flow rate that allows the vapor to be reliably adsorbed at the canister 15.

It is desirable that the flow rate of the air flowing through the vapor channel 14 to be high in order to quickly adsorb the vapor in the fuel tank 2 at the canister 15.

Accordingly, the desirable flow rate is the flow rate of the air containing vapor that flows through the vapor channel 14 to the canister 15 and is a highest flow rate that allows the vapor to be reliably adsorbed at the canister 15. Such a desirable flow rate is set as a design value of the vapor processing apparatus 1 on the basis of the adsorption ability, etc. of the canister 15.

As described above, the controller 10 according to the first embodiment sets the state in which the lid switch SW1 is operated to output an open command for the fuel lid 3*b* as a predetermined state. In the predetermined state, the controller 10 controls the opening and closing of the vapor control valve 14*a* on the basis of the value PA detected by the atmospheric-pressure sensor PS1, the value PTANK detected by the tank-inner-pressure sensor PS2, and the correction value Prev.

Specifically, the controller 10 calculates the corrected gauge pressure by correcting the tank inner gauge pressure, which is based on atmospheric pressure and calculated from the value PA detected by the atmospheric-pressure sensor PS1 and the value PTANK detected by the tank-inner-pressure sensor PS2, and controls the opening and closing of the vapor control valve 14*a* on the basis of the calculated corrected gauge pressure.

When the vapor control valve 14*a* is an opening control valve, the controller 10 sets the degree of opening of the vapor control valve 14*a* on the basis of the corrected gauge pressure.

The controller 10 calculates the difference (PA−PTANK) between the value PA detected by the atmospheric-pressure sensor PS1 and the value PTANK of the tank-inner-pressure sensor PS2 when the atmospheric pressure (absolute pressure) and the tank inner pressure (absolute pressure) are equal due to, for example, the fuel cap (not shown) being removed and the filler pipe opening 3*a* being opened for fueling, sets the difference as the correction value Prev, and stores the correction value Prev. In other words, the controller 10 learns the correction value Prev.

The process of learning a correction value Prev performed by the controller 10 will be described below with reference to FIG. 2 (and FIG. 1 when appropriate).

For example, upon detecting (Step S1) an open command for the fuel lid 3*b*, which is output in response to the driving operating the lid switch SW1 so as to open the fuel lid 3*b* for fueling, the controller 10 starts the correction-value learning process and acquires the value PA detected by the atmospheric-pressure sensor PS1 (Step S2).

The controller 10 acquires the value PTANK detected by the tank-inner-pressure sensor PS2 (Step S3).

The controller 10 calculates the tank inner gauge pressure from the value PA detected by the atmospheric-pressure sensor PS1 and the value PTANK detected by the tank-inner-pressure sensor PS2 and opens the vapor control valve 14*a* (Step S4). When the vapor control valve 14*a* is an opening control valve, the controller 10 may set the degree of opening of the vapor control valve 14*a* in accordance with the calculated tank inner gauge pressure and open the vapor control valve 14*a* by the set degree of opening.

At this time, when a learned correction value Prev is stored, the controller 10 sets the corrected gauge pressure calculated using Expression 1 as the tank inner gauge pressure and sets the degree of opening of the vapor control valve 14*a* in accordance with the corrected gauge pressure.

Then, the controller 10 enters stand-by until the values PTANK detected by the tank-inner-pressure sensor PS2 are stabilized (Step S5, NO). Once the values PTANK detected by the tank-inner-pressure sensor PS2 are stabilized (Step S5, YES), the controller 10 determines that the tank inner pressure equals the atmospheric pressure and releases the locked state of the fuel lid 3*b* by sending a control signal to the fuel lid 3*b*.

When the fuel lid 3*b* automatically opens and closes by an actuator (not shown), the controller 10 sends a control signal to the actuator to open the fuel lid 3*b*.

When the variation in the values PTANK detected by the tank-inner-pressure sensor PS2 is smaller than a threshold set in advance, the controller 10 determines that the tank inner pressure of the fuel tank 2 is reduced to equal the atmospheric pressure and that the values PTANK detected by the tank-inner-pressure sensor PS2 are stabilized.

At this time, the threshold is a value determined appropriately on the basis of the detection sensibility, etc. of the tank-inner-pressure sensor PS2.

In this way, after opening the vapor control valve 14*a*, the controller 10 according to this embodiment determines that the tank inner pressure equals the atmospheric pressure when the variation in the values PTANK detected by the tank-inner-pressure sensor PS2 is smaller than a threshold set in advance.

The controller 10 may determine that the tank inner pressure equals the atmospheric pressure when the locked state of the fuel lid 3*b* is released.

At this point, the controller 10 acquires the value PTANK detected by the tank-inner-pressure sensor PS2 (Step S6) again, subtracts the value PTANK detected by the tank-inner-pressure sensor PS2 from the value PA detected by the atmospheric-pressure sensor PS1, and calculates the correction value Prev (Step S7). The controller 10 stores the calculated correction value Prev in the storage unit (not shown) (Step S8). Then, the correction value learning process ends.

Upon detecting the next open command for the fuel lid 3*b*, the controller 10 corrects the tank inner gauge pressure calculated from the value PA detected by the atmospheric-pressure sensor PS1 and the value PTANK detected by the tank-inner-pressure sensor PS2 with the correction value Prev learned in the correction value learning process to calculate the corrected gauge pressure. Then, the vapor control valve 14*a* is opened on the basis of the calculated corrected gauge pressure. In other words, the controller 10 controls the opening and closing of the vapor control valve 14*a*. When the vapor control valve 14*a* is an opening control valve, the controller 10 can set the degree of opening of the vapor control valve 14*a* on the basis of the calculated corrected gauge pressure.

Figure 2:
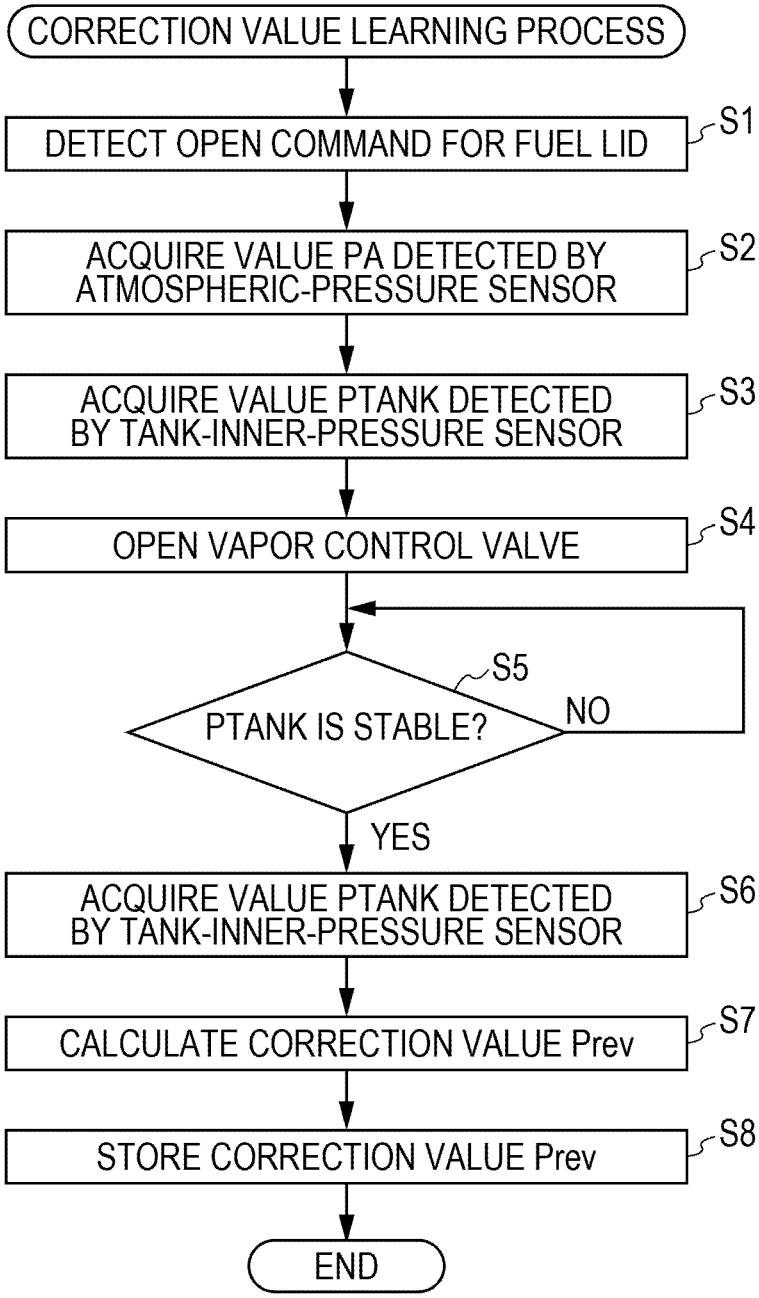
FIG. 2 is a flow chart illustrating a correction-value learning process according to the first embodiment.

The controller 10 learns the errors in the value PTANK detected by the tank-inner-pressure sensor PS2 and the value PA detected by the atmospheric-pressure sensor PS1 as the correction value Prev by performing the correction value learning process illustrated in FIG. 2, when the tank inner pressure and the atmospheric pressure are equal. Then, as described above, even when an error occurs in at least one of the atmospheric-pressure sensor PS1 and the tank-inner-pressure sensor PS2, the controller 10 performs correction using the correction value Prev, can calculate accurate corrected gauge pressure by absorbing the error, and can precisely control the opening and closing of the vapor control valve 14*a* on the basis of the calculated corrected gauge pressure.

For example, when a driver starts a fueling operation, the tank inner pressure rises due to fuel entering the fuel tank 2, which is illustrated in FIG. 1, and the tank-inner-pressure sensor PS2 cannot detect accurate tank inner pressure. Thus, the accuracy of the correction value Prev learned on the basis of the value PTANK detected by the tank-inner-pressure sensor PS2 will be low. Therefore, the learning process of the correction value Prev may be cancelled when the controller 10 determines that the driver has started the fuel operation.

In such a case, the controller 10 determines that the fueling operation has started when the value PTANK detected by the tank-inner-pressure sensor PS2 rises while the vapor control valve 14*a* is closed or when the fuel amount inside the fuel tank 2 detected by an oil meter (not shown) increases.

The controller 10 may open the vapor control valve 14*a* and learn the correction value Prev when the value PTANK detected by the tank-inner-pressure sensor PS2 is substantially equal to atmospheric pressure or is negative pressure because the vapor generated in the fuel tank 2 does not flow into the canister 15. In such a case, the controller 10 may carry out a step of determining whether the value PTANK detected by the tank-inner-pressure sensor PS2 is substantially equal to atmospheric pressure or is negative pressure, for example, at the beginning of the correction value learning process.

Second Embodiment

A second embodiment of the present invention will be described below with reference to FIG. 3.

Figure 3:
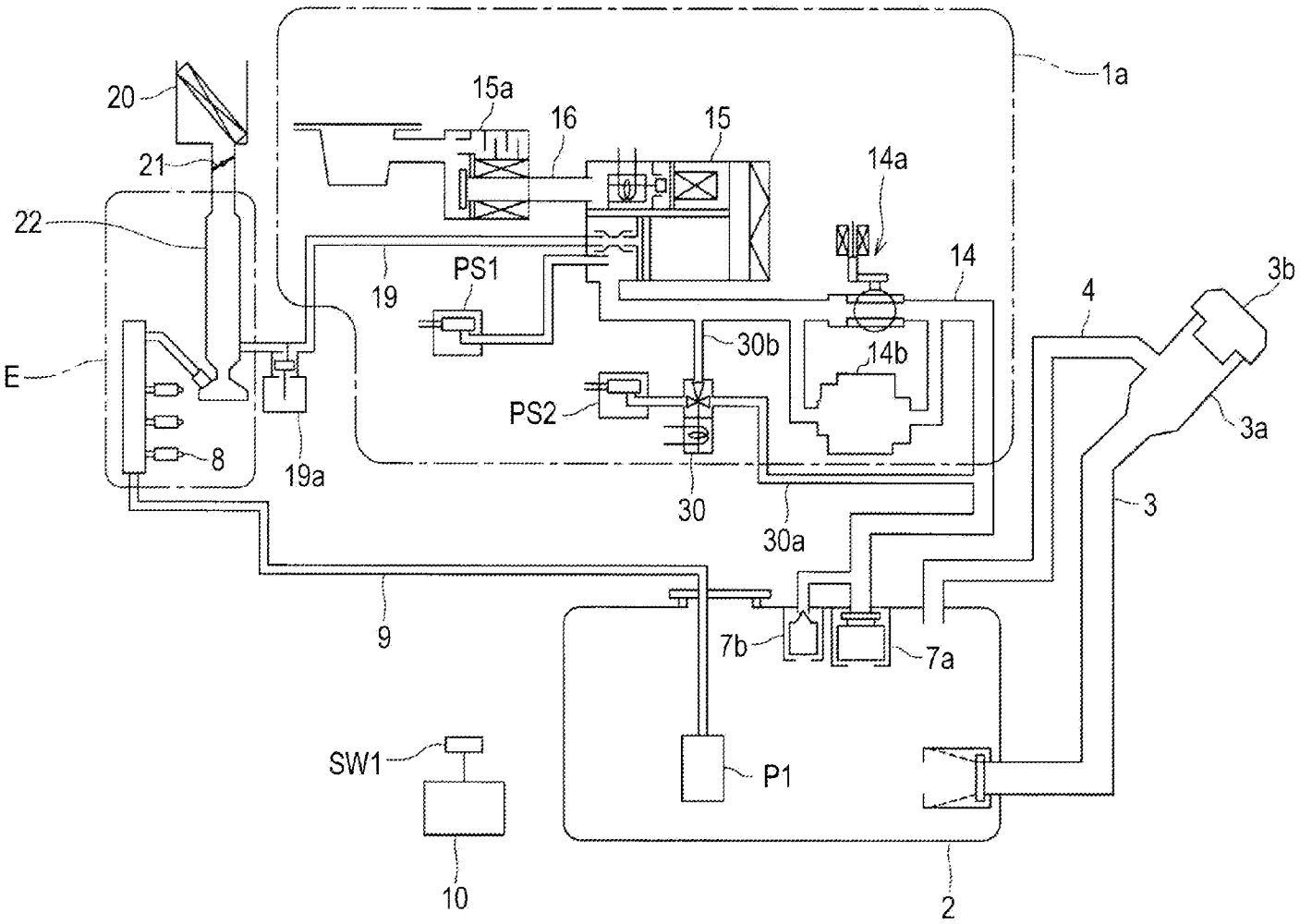
FIG. 3 illustrates a fuel supply system including a vapor processing apparatus according to a second embodiment.

As illustrated in FIG. 3, a vapor processing apparatus 1*a* according to the second embodiment includes a switching section (three-way valve 30), which is not included in the vapor processing apparatus 1 according to the first embodiment illustrated in FIG. 1. The three-way valve 30 switches between a state in which the tank-inner-pressure sensor PS2 detects the tank inner pressure of the fuel tank 2 and a state in which the tank-inner-pressure sensor PS2 detects the atmospheric pressure.

As illustrated in FIG. 3, the tank-side pressure pipe 30*a* interposed between the vapor channel 14 and the tank-inner-pressure sensor PS2 is connected to an atmospheric-pressure pressure pipe 30*b*, which takes in atmospheric pressure, via the three-way valve 30. The atmospheric-pressure pressure pipe 30*b* is connected to, for example, a part of the canister 15, which is exposed to the atmospheric pressure.

Other configurations of the fuel supply system illustrated in FIG. 3 are the same as those illustrated in FIG. 1. Components in the fuel supply system illustrated in FIG. 3 that are the same as those in the fuel supply system illustrated FIG. 1 are represented by the same reference numerals, and descriptions thereof are not repeated.

The three-way valve 30 is an electromagnetic valve that switches between a state in which the tank-side pressure pipe 30*a* and the tank-inner-pressure sensor PS2 are communicating (hereinafter, referred to as "tank-inner-pressure detection mode") and a state in which the atmospheric-pressure pressure pipe 30*b* and the tank-inner-pressure sensor PS2 are communicating (hereinafter, referred to as "atmospheric-pressure detection mode"), in response to a command from the controller 10.

The tank-inner-pressure detection mode is a state in which the tank-inner-pressure sensor PS2 detects the tank inner pressure and is equivalent to a first state according to the embodiment of the present invention. The atmospheric-pressure detection mode is a state in which atmospheric pressure is detected by the tank-inner-pressure sensor PS2 and is equivalent to a second state according to the embodiment of the present invention.

As illustrated in FIG. 3, the vapor processing apparatus 1*a* can constantly detect the atmospheric pressure with both the atmospheric-pressure sensor PS1 and the tank-inner-pressure sensor PS2 by, for example, switching the three-way valve 30 to the atmospheric-pressure detection mode and can compare the value PA detected by the atmospheric-pressure sensor PS1 and a value PA2 of the atmospheric pressure detected by the tank-inner-pressure sensor PS2.

When error does not occur in the atmospheric-pressure sensor PS1 and the tank-inner-pressure sensor PS2, the value PA (absolute pressure) detected by the atmospheric-pressure sensor PS1 and the value PA2 (absolute value) detected by the tank-inner-pressure sensor PS2 are equal. In other words, PA=PA2.

When an error occurs in at least one of the atmospheric-pressure sensor PS1 and the tank-inner-pressure sensor PS2, the value PA detected by the atmospheric-pressure sensor PS1 and the value PA2 detected by the tank-inner-pressure sensor PS2 are not equal.

In the second embodiment, when the lid switch SW1 is not operated and an open command for the fuel lid 3*b* is not output, i.e., when not in the predetermined state, the controller 10 switches the three-way valve 30 to the atmospheric-pressure detection mode and compares the value PA detected by the atmospheric-pressure sensor PS1 and the value PA2 detected by the tank-inner-pressure sensor PS2, for example, at predetermined time intervals (such as 5 minutes, 10 minute, or 30 minutes) set appropriately.

The value obtained by subtracting the value PA2 detected by the tank-inner-pressure sensor PS2 from the value PA detected by the atmospheric-pressure sensor PS1, i.e., PA−PA2, is set as a correction value Prev.

For example, when the value PA detected by the atmospheric-pressure sensor PS1 is 760 mmHg (1013.2 hPa), and the value PA2 detected by the tank-inner-pressure sensor PS2 when the three-way valve 30 is in the atmospheric-pressure detection mode is 762 mmHg (1015.9 hPa), the correction value Prev is −2 mmHg (−2.7 hPa).

The controller 10 learns correction values by storing the correction value Prev calculated as described above in a storage unit (for example, non-volatile memory) (not shown).

In this way, the controller 10 learns correction values at predetermined time intervals. In such a case, the correction value Prev calculated at last may be stored or an average value (moving average deviation) of the correction values Prev acquired in sequence through the learning process may be stored.

Then, upon detecting an open command output by operating the lid switch SW1, the controller 10 opens the vapor control valve 14*a*. At this time, the three-way valve 30 is switched to the tank-inner-pressure detection mode to detect the tank inner pressure (absolute pressure) by the tank-inner-pressure sensor PS2, and the tank inner gauge pressure calculated from difference between the value PTANK detected by the tank-inner-pressure sensor PS2 and the value PA detected by the atmospheric-pressure sensor PS1 is corrected using the learned correction value Prev to calculate the corrected gauge pressure. Specifically, the controller 10 sets the pressure value obtained using Expression 1 (PTANK−PA)+Prev as the corrected gauge pressure.

With this configuration, the controller 10 can update (learn) the correction value Prev at predetermined time intervals and can acquire a correction value Prev corresponding to the temporal change in errors that occur in at least one of the atmospheric-pressure sensor PS1 and the tank-inner-pressure sensor PS2.

Hence, the controller 10 can acquire a correction value Prev that corresponds to the error in the atmospheric-pressure sensor PS1 and/or tank-inner-pressure sensor PS2, which is generated or changed in response to, for example, environmental changes (altitude, temperature, etc.) of the hybrid vehicle. The controller 10 corrects the tank inner gauge pressure, which is calculated from the value PA detected by the atmospheric-pressure sensor PS1 and the value PTANK detected by the tank-inner-pressure sensor PS2, which is acquired when the three-way valve 30 is in the tank-inner-pressure detection mode, using the correction value Prev to absorb an error that occurs at least one of the atmospheric-pressure sensor PS1 and the tank-inner-pressure sensor PS2, which is generated or changed in response to the environment of the hybrid vehicle, allowing the corrected gauge pressure to be calculated accurately.

The process of learning a correction value (correction-value learning process) performed by the controller 10 according to the second embodiment will be described below with reference to FIG. 4 (and FIG. 3 when appropriate).

The controller 10 switches the three-way valve 30 to the atmospheric-pressure detection mode (Step S20) and acquires the value PA detected by the atmospheric-pressure sensor PS1 (Step S21).

The controller 10 acquires the value PA2 detected by the tank-inner-pressure sensor PS2 (Step S22). Then, the controller 10 calculates the correction value Prev by subtracting the value PA2 detected by the tank-inner-pressure sensor PS2 from the value PA detected by the atmospheric-pressure sensor PS1 (Step S23) and stores the calculated correction value Prev in a storage unit (not shown) (Step S24).

When a predetermined amount of time has not elapsed (Step S25, NO), the controller 10 determines whether an open command for the fuel lid 3*b* output from the lid switch SW1 is detected (Step S26). When an open command is not detected (Step S26, NO), the controller 10 enters stand-by until the predetermined amount of time elapses. When the lid switch SW1 is operated and an open command for the fuel lid 3*b* is detected (Step S26, YES), the process proceeds to Step S27.

In Step S25, when the predetermined amount of time has elapsed (Step S25, YES), the controller 10 returns to Step S21.

In Step S25, the predetermined amount of time for which the controller 10 remains in stand-by is equal to the predetermined time interval set appropriately.

In Step S27, the controller 10 switches the three-way valve 30 to the tank-inner-pressure detection mode and acquires the value PTANK detected by the tank-inner-pressure sensor PS2 when the three-way valve 30 is in the tank-inner-pressure detection mode (Step S28).

Then, the controller 10 calculates the tank inner gauge pressure from the value PA detected by the atmospheric-pressure sensor PS1 and the value PTANK detected by the tank-inner-pressure sensor PS2 and opens the vapor control valve 14*a* (Step S29). At this time, if the learned correction value Prev is stored, the controller 10 sets the corrected gauge pressure calculated using Expression 1 as the tank inner gauge pressure and opens the vapor control valve 14*a* in accordance with the corrected gauge pressure.

When the vapor control valve 14*a* is an opening control valve, the controller 10 may set the degree of opening of the vapor control valve 14*a* in accordance with the calculated tank inner gauge pressure and open the vapor control valve 14*a* by the set degree of opening. At this time, if the learned correction value Prev is stored, the controller 10 sets the corrected gauge pressure calculated using Expression 1 as the tank inner gauge pressure and sets the degree of opening of the vapor control valve 14*a* in accordance with the corrected gauge pressure.

Then, the controller 10 enters stand-by until the values PTANK detected by the tank-inner-pressure sensor PS2 are stabilized (Step S30, NO). Once the values PTANK detected by the tank-inner-pressure sensor PS2 are stabilized (Step S30, YES), the controller 10 proceeds to the Step S31.

Similar to the first embodiment, the controller 10 determines that the tank inner pressure of the fuel tank 2 is decreased to equal the atmospheric pressure and that the values PTANK detected by the tank-inner-pressure sensor PS2 have stabilized, when the variation in the values PTANK detected by the tank-inner-pressure sensor PS2 is smaller than a threshold set in advance. At this time, the threshold is a value appropriately set on the basis of the detection sensitivity, etc., of the tank-inner-pressure sensor PS2.

In Step S31, the controller 10 sends a control signal to the fuel lid 3*b* to release the locked state of the fuel lid 3*b*. When the fuel lid 3*b* automatically opens and closes by an actuator (not shown), the controller 10 sends a control signal to the actuator to open the fuel lid 3*b*.

Then, the controller 10 enters stand-by with the fuel lid 3*b* in an unlocked state while a close command for the fuel lid 3*b* from a lid monitor (not shown) is not detected (Step S32, NO). Upon detecting a close command from the lid monitor (not shown) (Step S32, YES), the controller 10 locks the fuel lid 3*b* (Step S33). Then, the controller 10 closes the vapor control valve 14*a* (Step S34) and returns to Step S20.

Figure 4:
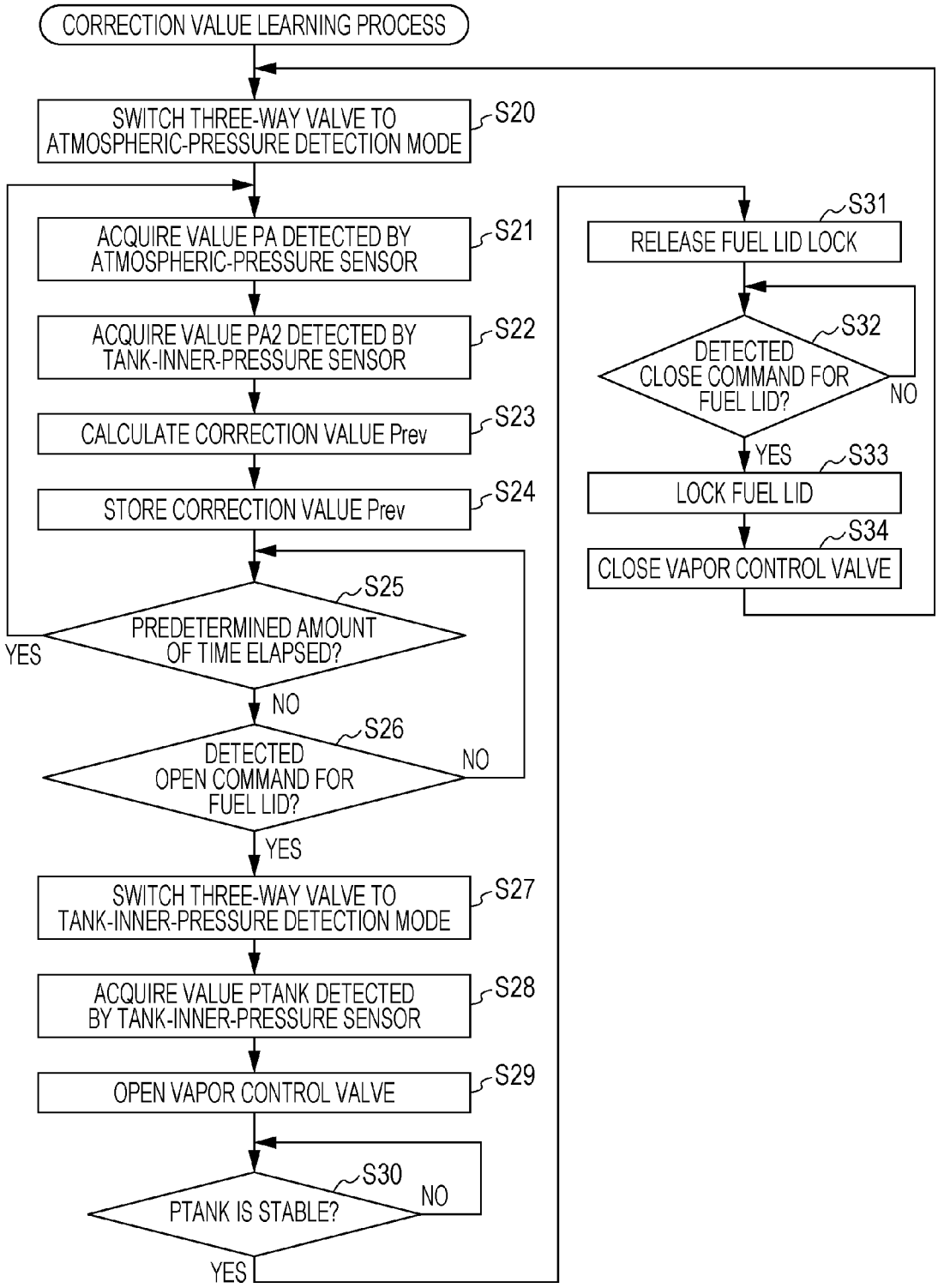
FIG. 4 is a flow chart illustrating a correction-value learning process according to the second embodiment.

In the second embodiment, the controller 10 (see FIG. 3) learns a correction value Prev, for example, through the process illustrated in FIG. 4. Accordingly, the controller 10 can learn correction values Prev at predetermined time intervals and, as described above, can acquire correction values Prev corresponding to the errors that occur in the atmospheric-pressure sensor PS1 and/or tank-inner-pressure sensor PS2, which are generated or changed in response to changes in the environment (altitude, temperature, etc.) of the hybrid vehicle.

Instead of learning the correction values Prev at predetermined time intervals, the controller 10 may learn correction values Prev, for example, at appropriately set predetermined traveling distances of the hybrid vehicle (such as 5, 10, and 100 km). In such a case, in Step S25 in FIG. 4, the controller 10 determines whether the hybrid vehicle has travelled a predetermined distance and returns to Step S21 if the hybrid vehicle has travelled the predetermined distance.

As described above, with the vapor processing apparatus 1 according to the first embodiment illustrated in FIG. 1, the controller 10 can learn a correction value Prev, for example, when the fuel lid 3*b* is opened for fueling. The controller 10 corrects the tank inner gauge pressure, which is calculated from the atmospheric pressure detected by the atmospheric-pressure sensor PS1 and the tank inner pressure detected by the tank-inner-pressure sensor PS2, using the correction value Prev to absorb the error that occurs in at least one of the atmospheric-pressure sensor PS1 and the tank-inner-pressure sensor PS2 and accurately calculates the accurate corrected gauge pressure. Then, the controller 10 controls the opening and closing of the vapor control valve 14*a* on the basis of the corrected gauge pressure, which is acquired by absorbing the error generated in the atmospheric-pressure sensor PS1 and/or tank-inner-pressure sensor PS2, such that the vapor is reliably adsorbed (collected) at the canister 15. In this way, the vapor can be reliably prevented from being discharged into the atmosphere.

With the vapor processing apparatus 1*a* according to the second embodiment illustrated in FIG. 3, the controller 10 can learn correction values Prev, for example, at predetermined time intervals. Then, the controller 10 corrects the tank inner gauge pressure, which is calculated from the atmospheric pressure detected by the atmospheric-pressure sensor PS1 and the tank inner pressure detected by the tank-inner-pressure sensor PS2, using the correction value Prev to absorb the error that occurs in at least one of the atmospheric-pressure sensor PS1 and the tank-inner-pressure sensor PS2 and accurately calculates the accurate corrected gauge pressure.

Then, the controller 10 controls the opening and closing of the vapor control valve 14*a* on the basis of the corrected gauge pressure, which is acquired by absorbing the error in the atmospheric-pressure sensor PS1 and/or tank-inner-pressure sensor PS2, to set the flow rate of the air flowing from the fuel tank 2 through the vapor control valve 14*a* at a desirable flow rate in accordance with the tank inner gauge pressure. In particular, when the vapor control valve 14*a* is an opening control valve, the controller 10 can set the degree of opening of the vapor control valve 14*a* on the basis of the corrected gauge pressure and can set the flow rate of the air flowing through the vapor channel 14 to a desirable flow rate.

Then, the vapor contained in the air flowing through the vapor channel 14 is satisfactorily adsorbed (collected) at the canister 15, and thus, the vapor is reliably prevented from being discharged into the atmosphere.

The controller 10 according to the first embodiment (see FIG. 1) determines the predetermined state on the basis of an operation signal from the lid switch SW1 (see FIG. 1), which is operated by a toggle. Instead, the lid switch SW1 may be a command output unit that operates by a trigger, such as a push switch. When the lid switch SW1 is a push switch, the controller 10 receives a pulsed operation signal output in response to the lid switch SW1 being pushed.

For example, the controller 10 (see FIG. 1) can recognize a pulsed operation signal received when the fuel lid 3*b* (see FIG. 1) is not open as an open command for the fuel lid 3*b*. Then, similar to when the lid switch SW1 is operated by a toggle, the controller 10 detects the output of the pulsed open command and learns the correction value Prev.

The fuel supply system according to the second embodiment may include a lid switch SW1 (see FIG. 3), which operates by a trigger, which is the same as that in the first embodiment. In this way, the controller 10 (see FIG. 3) recognizes a pulsed operation signal received when the fuel lid 3*b* (see FIG. 3) is not open as an open command. In such a case, after recognizing the operation signal as an open command, the controller 10 switches the three-way valve 30 to the tank-inner-pressure detection mode, which is the predetermined state, until a close command from the lid monitor (not shown) is detected. The controller 10 switches the three-way valve 30 to the atmospheric-pressure detection mode, which is not the predetermined state, during the period between detecting a close command and recognizing an operation signal as an open command and the period between starting up the controller 10 and the controller 10 receiving the first operation signal. The controller 10 learns the correction value Prev when the three-way valve 30 is switched to the atmospheric-pressure detection mode.

In this way, a lid switch SW1, which is operated by a trigger, may be included in the fuel supply system according to the second embodiment.

By constantly controlling the on-off valve of the vapor control valve 14*a* (see FIG. 1) with the controller 10 (see FIG. 1) in accordance with the tank inner pressure and adsorbing the vapor in the fuel tank 2 with an adsorbent in the canister 15 (see FIG. 1), rising of the tank inner pressure can be prevented, and the flow rate of the air flowing through the vapor channel 14 can be reduced.

Thus, highly accurate control of opening and closing the vapor control valve 14*a* in accordance with the tank inner pressure (tank inner gauge pressure) is less required.

In areas in which adsorbing vapor with an adsorbent in the canister 15 (see FIG. 1) while parking or driving a vehicle is prohibited by law, the vapor in the fuel tank 2 cannot be adsorbed at the canister 15 by constantly keeping the vapor control valve 14*a* (see FIG. 1) open while the tank inner pressure is high.

For example, when a hybrid vehicle runs on a driving motor, the engine E (see FIG. 1) is stopped, and thus, if the vapor control valve 14*a* is opened, the vapor cannot be combusted at the engine E and is adsorbed by the adsorbent in the canister 15. Therefore, in such areas, the vapor control valve 14*a* cannot be opened while a hybrid vehicle is running by a driving motor.

In such areas, adsorbing vapor with an adsorbent in the canister 15 (see FIG. 1) is often allowed only under limited circumstance, such as during fueling. Therefore, when a hybrid vehicle is in a condition in which vapor is allowed to be adsorbed with the adsorbent in the canister 15, the tank inner pressure may be high, and thus, the opening and closing of the vapor control valve 14*a* needs to be accurately controlled in accordance with the tank inner gauge pressure.

The present invention is particularly advantageous in such areas.

The present invention is not limited to hybrid vehicles and may be applied to a wide range of vehicles including engines driven by volatile fuel, such as gasoline.

It is possible for the controller 10 (see FIG. 1) to use the correction value Prev to diagnose fuel leakage from the fuel tank 2 (see FIG. 1).

For example, the controller 10 determines that fuel is leaking from the fuel tank 2 if the tank inner pressure equals the atmospheric pressure when the fuel lid 3*b* (see FIG. 1) is not open.

However, when there is an error in the atmospheric-pressure sensor PS1 (see FIG. 1) and/or the tank-inner-pressure sensor PS2 (see FIG. 1), the value PTANK detected by the tank-inner-pressure sensor PS2 and the value PA detected by the atmospheric-pressure sensor PS1 do not equal even if fuel is leaking from the fuel tank 2, and thus, the controller 10 cannot correctly detect fuel leakage from the fuel tank 2.

The controller 10 illustrated in FIG. 1 can calculate the errors in the atmospheric-pressure sensor PS1 and the tank-inner-pressure sensor PS2 as the correction value Prev.

Thus, for example, even if the value PA detected by the atmospheric-pressure sensor PS1 and the value PTANK detected by the tank-inner-pressure sensor PS2 are not equal, the controller 10 can determined that the tank inner pressure is equal to the atmospheric pressure and can determined that fuel is leaking from the fuel tank 2 if the difference (PA–PTANK) between the value PA detected by the atmospheric-pressure sensor PS1 and the value PTANK detected by the tank-inner-pressure sensor PS2 is equal to the correction value Prev.

In this way, even when there is an error in the atmospheric-pressure sensor PS1 and/or the tank-inner-pressure sensor PS2, the controller 10 can use the correction value Prev to determine fuel leakage from the fuel tank 2.

Obviously, numerous modifications and variations of the present invention are possible in light of the above teachings. It is therefore to be understood that within the scope of the appended claims, the invention may be practiced otherwise than as specifically described herein.

What is claimed is:

1. A vapor processing apparatus comprising:

a tank-inner-pressure detector configured to detect tank inner pressure of a fuel tank retaining fuel to be supplied to an engine;

an atmospheric-pressure detector configured to detect atmospheric pressure;

a canister configured to adsorb and collect vapor generated in the fuel tank;

a control valve disposed in a vapor channel connected to the fuel tank; and a controller configured to control opening and closing of the control valve based on a value detected by the tank-inner-pressure detector, a value detected by the atmospheric-pressure detector, and a correction value learned in advance, when in a predetermined state.

2. The vapor processing apparatus according to claim 1, wherein the controller is configured to calculate gauge pressure of the tank inner pressure based on the atmospheric pressure on a basis of the value detected by the tank-inner-pressure detector and the value detected by the atmospheric-pressure detector, and is configured to control the opening and closing of the control valve based on corrected gauge pressure obtained by correcting the calculated gauge pressure of the tank inner pressure with the correction value.

3. The vapor processing apparatus according to claim 1, wherein the controller is configured to learn the correction value based on a difference between the value detected by the tank-inner-pressure detector when the tank inner pressure is equal to the atmospheric pressure and the value detected by the atmospheric-pressure detector.

4. The vapor processing apparatus according to claim 3, wherein the tank inner pressure is equal to the atmospheric pressure when a locked state of a fuel lid is released, the fuel lid being configured to open and close a filler pipe opening of the fuel tank.

5. The vapor processing apparatus according to claim 3, wherein the tank inner pressure is equal to the atmospheric pressure when, after the control valve is open, a variation of the value detected by the tank-inner-pressure detector is smaller than a threshold set in advance.

6. The vapor processing apparatus according to claim 1, further comprising:

a switch configured to switch a state of the tank-inner-pressure detector between a first state of the tank-inner-pressure detector detecting the tank inner pressure and a second state of the tank-inner-pressure detector detecting the atmospheric pressure, wherein the controller controls the switch to switch the state of the tank-inner-pressure detector to the first state when in the predetermined state and controls the opening and closing of the control valve based on the value detected by the tank-inner-pressure detector, the value detected by the atmospheric-pressure detector, and the correction value, and the controller controls the switch to switch the state of the tank-inner-pressure detector to the second state when in a state other than the predetermined state and learns the correction value.

7. The vapor processing apparatus according to claim 6, the controller learns the correction value based on a difference between the value detected by the tank-inner-pressure detector and the value detected by the atmospheric-pressure detector when the state of the tank-inner-pressure detector is switched to the second state.

8. The vapor processing apparatus according to claim 1, wherein the controller is configured to calculate a difference between the value detected by the tank-inner-pressure detector when the tank inner pressure is equal to the atmospheric pressure and the value detected by the atmospheric-pressure detector, and to store the calculated difference as the correction value.

* * * * *